US007575039B2

(12) United States Patent
Beals et al.

(10) Patent No.: US 7,575,039 B2
(45) Date of Patent: Aug. 18, 2009

(54) REFRACTORY METAL CORE COATINGS

(75) Inventors: James T. Beals, West Hartford, CT (US); Joshua Persky, Manchester, CT (US); Dilip M. Shah, Glastonbury, CT (US); Venkat Seetharaman, Rocky Hill, CT (US); Sudhangshu Bose, Manchester, CT (US); Jacob Snyder, Southington, CT (US); Keith Santeler, Middletown, CT (US); Carl Verner, Windsor, CT (US); Stephen D. Murray, Marlborough, CT (US); John Marcin, Marlborough, CT (US); Dinesh Gupta, South Windsor, CT (US); Daniel A. Bales, Avon, CT (US); Daniel Francis Paulonis, Higganum, CT (US); Glenn Cotnoir, Thompson, CT (US); John Wiedemer, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 971 days.

(21) Appl. No.: 10/685,631

(22) Filed: Oct. 15, 2003

(65) Prior Publication Data

US 2009/0114797 A1 May 7, 2009

(51) Int. Cl.
*B22C 9/10* (2006.01)

(52) U.S. Cl. ..... 164/369

(58) Field of Classification Search ..... 164/369, 164/132, 267, 72; 428/368, 369, 380, 384, 428/389, 689; 427/419.2, 499.7
See application file for complete search history.

(56) References Cited

U.S. PATENT DOCUMENTS

| | | | | | |
|---|---|---|---|---|---|
| 2,679,669 | A | * | 6/1954 | Kempe | 164/32 |
| 2,682,101 | A | * | 6/1954 | Whitfield et al. | 428/651 |
| 2,870,527 | A | * | 1/1959 | Runck et al. | 428/553 |
| 3,011,233 | A | * | 12/1961 | Kirtchik | 164/369 |
| 3,057,048 | A | * | 10/1962 | Hirakis | 428/559 |
| 3,142,875 | A | * | 8/1964 | Lirones et al. | 164/32 |
| 3,177,094 | A | * | 4/1965 | Dijksterhuis et al. | 428/368 |
| 3,372,297 | A | * | 3/1968 | Pearsall et al. | 313/337 |
| 3,383,235 | A | * | 5/1968 | Blackburn et al. | 428/629 |
| 3,390,013 | A | * | 6/1968 | Rubisch | 428/408 |
| 3,837,894 | A | * | 9/1974 | Tucker, Jr. | 427/419.2 |
| 3,957,104 | A | * | 5/1976 | Terpay | 164/132 |
| 4,096,296 | A | * | 6/1978 | Galmiche et al. | 427/247 |
| 4,287,932 | A | * | 9/1981 | Schneider | 164/516 |
| 4,293,619 | A | * | 10/1981 | Landingham et al. | 428/623 |
| 4,404,009 | A | * | 9/1983 | Bhatti et al. | 65/475 |
| 4,579,752 | A | * | 4/1986 | Dubois et al. | 427/255.18 |
| 4,762,557 | A | * | 8/1988 | Nagarajan et al. | 75/244 |
| 5,070,591 | A | * | 12/1991 | Quick et al. | 29/527.4 |
| 5,223,045 | A | * | 6/1993 | Priceman | 148/268 |
| 5,270,112 | A | * | 12/1993 | Lukco et al. | 428/368 |
| 5,308,806 | A | * | 5/1994 | Maloney et al. | 501/95.2 |
| 5,472,795 | A | * | 12/1995 | Atita | 428/660 |
| 5,514,482 | A | * | 5/1996 | Strangman | 428/623 |
| 5,677,060 | A | * | 10/1997 | Terentieva et al. | 428/408 |
| 6,214,474 | B1 | * | 4/2001 | Barbist et al. | 428/469 |
| 6,228,510 | B1 | * | 5/2001 | Chen et al. | 428/615 |
| 6,299,988 | B1 | * | 10/2001 | Wang et al. | 428/632 |
| 6,620,525 | B1 | * | 9/2003 | Rigney et al. | 428/633 |
| 6,637,500 | B2 | * | 10/2003 | Shah et al. | 164/369 |
| 6,668,906 | B2 | * | 12/2003 | Burd | 164/302 |
| 6,746,782 | B2 | * | 6/2004 | Zhao et al. | 428/632 |
| 6,749,942 | B1 | * | 6/2004 | Wittenauer et al. | 428/446 |
| 2003/0075300 | A1 | | 4/2003 | Shah et al. | |

FOREIGN PATENT DOCUMENTS

| | | |
|---|---|---|
| EP | 1 306 147 | 5/2003 |
| EP | 1 358 954 | 11/2003 |
| JP | 56-139256 | 10/1981 |
| JP | 60-012247 | 1/1985 |
| JP | 2002-283004 | 10/2002 |
| JP | 2002-346724 | 12/2002 |
| JP | 2003-181599 | 7/2003 |

* cited by examiner

*Primary Examiner*—Kevin P Kerns
(74) *Attorney, Agent, or Firm*—Bachman & LaPointe, P.C.

(57) ABSTRACT

A refractory metal core for use in a casting system has a coating for providing oxidation resistance during shell fire and protection against reaction/dissolution during casting. In a first embodiment, the coating includes at least one oxide and a silicon containing material. In a second embodiment, the coating includes an oxide selected from the group of calcia, magnesia, alumina, zirconia, chromia, yttria, silica, hafnia, and mixtures thereof. In a third embodiment, the coating includes a nitride selected from the group of silicon nitride, sialon, titanium nitride, and mixtures thereof. Other coating embodiments are described in the disclosure.

8 Claims, No Drawings

REFRACTORY METAL CORE COATINGS

BACKGROUND OF THE INVENTION

The present invention relates to coatings to be applied to refractory metal cores to protect the cores from oxidizing during shellfire and from reaction/dissolution during the casting process.

Investment casting is a commonly used technique for forming metallic components having complex geometries, especially hollow components, and is used in the fabrication of superalloy gas turbine engine components. The present invention will be described in respect to the production of superalloy castings, however it will be understood that the invention is not so limited.

Cores used in investment casting techniques are fabricated from ceramic materials which are fragile, especially the advanced cores used to fabricate small intricate cooling passages in advanced gas turbine engine hardware. These ceramic cores are prone to warpage and fracture during fabrication and during casting.

Conventional ceramic cores are produced by a molding process using a ceramic slurry and a shaped die. The pattern material is most commonly wax although plastics and organic compounds, such as urea, have also been employed. The shell mold is formed using a colloidal silica binder to bind together ceramic particles which may be alumina, silica, zirconia, and aluminum silicates.

The investment casting process used to produce a turbine blade, using a ceramic core is as follows. A ceramic core having the geometry desired for the internal cooling passages is placed in a metal die whose walls surround but are generally spaced away from the core. The die is filled with a disposable pattern material such as wax. The die is removed leaving the ceramic core embedded in a wax pattern. The outer shell mold is then formed about the wax pattern by dipping the pattern in a ceramic slurry and then applying larger, dry ceramic particles to the slurry. This process is termed stuccoing. The stuccoed wax pattern, containing the core is then dried and the stuccoing process repeated to provide the desired shell mold wall thickness. At this point, the mold is thoroughly dried to obtain green strength and the wax removed by application of high pressure steam which removes much of the wax from inside of the ceramic shell. The mold is then fired at high temperature to remove the remainder of the residual wax and to strengthen the ceramic material for the casting operation.

The result is a ceramic mold containing a ceramic core which in combination define a mold cavity. It will be understood that the exterior of the core defines the passageway to be formed in the casting and the interior of the shell mold defines the external dimensions of the superalloy casting to be made. The core and shell may also define other features such as core supports to stabilize the core or other gating which acts to channel metal into the cast component. Some of these features may not be a part of the finished cast part but are necessary for obtaining a good casting.

After removal of the wax, molten superalloy material is poured into the cavity defined by the shell mold and core assembly and solidified. The mold and core are then removed from the superalloy casting by a combination of mechanical and chemical means.

Attempts have been made to provide cores for investment casting which have improved mechanical properties, thinner thicknesses, improved resistance to thermal shock, and new geometries and features. One such attempt is shown in published U.S. Patent Application No. 2003/0075300, which is incorporated by reference herein. These efforts have been to provide ceramic cores with embedded refractory metal elements.

While it has been recognized that coatings are desirable to improve the performance of the refractory metal cores, there remains a need to define particularly useful coatings. Currently, chemical vapor deposition of aluminum oxide (alumina) is the baseline process/composition primarily due to availability and the excellent compatibility of alumina with molten nickel superalloys. A significant coefficient of thermal expansion (CTE) mismatch exists between the refractory metal/alumina that produces a microcracked coating. In its microcracked condition, the baseline coating is not entirely oxidation resistant during the investment shellfire.

SUMMARY OF THE INVENTION

It is an object of the present invention to provide coatings for refractory core elements which have a reduced tendency for microcracking.

It is a further object of the present invention to provide coatings for refractory core elements which have improved oxidation resistance.

The foregoing objects are attained by the coatings of the present invention.

In a first embodiment, a refractory metal core for use in a casting system has a coating for providing oxidation resistance during shell fire and protection against reaction/dissolution during casting. The coating comprises at least one oxide and/or a silicon containing material or a stable oxide former.

In a second embodiment, a refractory metal core for use in a casting system has a coating for providing oxidation resistance during shell fire and protection against reaction/dissolution during casting. The coating comprises an oxide selected from the group consisting of magnesia, alumina, calcia, zirconia, chromia, yttria, silica, hafnia, and mixtures thereof.

In a third embodiment, a refractory metal core for use in a casting system is provided, which refractory metal core has a coating for providing oxidation resistance during shell fire and protection against reaction/dissolution during casting. The coating comprises a nitride selected from the group consisting of silicon nitride, sialon, titanium nitride, and mixtures thereof.

In a fourth embodiment, a refractory metal core for use in a casting system is provided, which refractory metal core has a coating for providing oxidation resistance during shell fire and protection against reaction/dissolution during casting. The coating comprises a carbide selected from the group consisting of silicon carbide, titanium carbide, tantalum carbide and mixtures thereof.

In a fifth embodiment, a refractory metal core for use in a casting system is provided, which refractory metal core has a coating for providing oxidation resistance during shell fire and protection against reaction/dissolution during casting. The coating comprises a ceramic coating and at least one layer between the refractory metal forming the refractory metal core and said ceramic coating.

In a sixth embodiment, a refractory metal core for use in a casting system is provided, which refractory metal core has a coating for providing oxidation resistance during shell fire and protection against reaction/dissolution during casting. The refractory metal core is formed from molybdenum and has an etched surface. The etched surface may be formed using any suitable technique known in the art. The coating comprises alumina which has been chemically vapor deposited.

In a seventh embodiment, a refractory metal core for use in a casting system is provided, which refractory metal core has a base coating for providing oxidation resistance during shell fire and protection against reaction/dissolution during casting, and further has a top coat overlaying the base coating.

In an eighth embodiment, a refractory metal core for use in a casting system is provided, which refractory metal core has a coating for providing oxidation resistance during shell fire and protection against reaction/dissolution during casting. The coating comprises alternating layers of alumina and a material selected from the group consisting of TiC, TiN, TiCN, and zirconia.

Other details of the refractory metal core coatings, as well as other objects and advantages attendant thereto, are set forth in the following detailed description.

DETAILED DESCRIPTION OF THE PREFERRED EMBODIMENT(S)

Refractory metal cores are a ductile based coring system for creating intricate cooling channels in cast components. The intricate metal cores are formed from refractory metals selected from the group consisting of molybdenum, tantalum, niobium, tungsten, alloys thereof, and intermetallic compounds thereof. A preferred material for the refractory metal core is molybdenum and its alloys.

One of the key components to high yield of the refractory metal cores is a robust oxidation, dissolution/reaction barrier coating applied to the refractory metal core. The coating protects the refractory metal from oxidizing during shellfire and from reaction/dissolution during the casting process. Depending on the alloy (usually nickel based superalloys) and condition (equiaxed, DS, SX), molten metal may be in contact with the refractory metal core for a significant amount of time (SX) or be rapid (equiaxed). The type/properties of coatings may vary for the different conditions (i.e., SX castings require a much more effective refractory metal core dissolution barrier than equiaxed).

The choice of the coating composition to be used and application method is predicated by many factors. Chemical compatibility with both refractory metal and cast alloy at process conditions is one such factor. For example, while some reaction with the refractory metal may be desired for good adherence, extensive reaction may embrittle or limit leachability. Also, active alloy additions require a more inert coating.

Another factor is physical property match. For example, a coating which has a coefficient of thermal expansion (CTE) close to that of the refractory metal is desirable to reduce mismatch cracking during processing. Strain compliance or porosity of the coating is another physical property which may be considered.

Yet another factor is the need for a thin and uniform coating process to retain cast features, which favors non-line-of-sight processes. With regard to leachability, it is desirable that the coating be removable from casting without base metal damage.

One useful coating to be applied to the refractory metal core is a mixed oxide-alumina silicate composition wherein the aluminum silicate may be mullite. Such a coating is advantageous because it better matches the CTE of refractory metals. The coating may include a silicon rich layer closer to the substrate for better adherence and an alumina rich exterior for better compatibility with active alloy additions. Zirconium silicate (zircon) is another mixed oxide that may be used. It has a compatible CTE. The mixed oxide coatings may be applied using a wide variety of application methods including, but not limited to, chemical vapor deposition, electrophoretic process, plasma spray techniques, etc.

Another useful coating include ceramic coatings formed from oxides such as zirconia, yttria, hafnia, and mixtures thereof. Alternatively, the coatings may include nitrides such as silicon nitrides, sialon, titanium nitride, and mixtures thereof. Still further, the coatings may include carbides such as silicon carbide, titanium carbide, tantalum carbide, and mixtures thereof. The coating may also be a silicide such as molybdenum disilicide.

One technique which may be used to improve the coating applied to the refractory metal core involves vapor honing/acid etching and anodic etching to increase mechanical bonding of CVD deposited alumina on molybdenum.

One or more interlayers can be used to help increase adherence of a ceramic coating as well as increase oxidation resistance. The layer or layers between the refractory metal, such as molybdenum, and the ceramic can be applied by plating or other coating means. The layer(s) may be formed from a metal selected from the group including nickel, platinum, chromium, silicon, alloys thereof, and mixtures thereof. Alternatively, the layer(s) may be formed from intermetallics such as NiAl, MCrAlY, $MoSi_2$. Carbides and nitrides, such as TiC, TiN, and $Si_3N_4$, may be used between a refractory metal/oxide coating or directly between a molybdenum/oxide.

In yet another embodiment of the coatings of the present invention, the oxidation resistance of the refractory metal core can be increased by over coating the base coating. The over coating may be a ceramic, such as multi-layered alumina, chromia, yttria, and mixtures thereof; metals, such as nickel, chromium, platinum, alloys and mixtures thereof; and/or intermetallics, such as aluminides, silicides, and mixtures thereof. Over coats can be applied by plating, chemical vapor deposition, or other coating methods.

In still another embodiment, the coatings of the present invention may include laminate coatings. In these coatings, multiple alternating layers of coatings may be used to help increase adherence, reduce CTE mismatch, and/or nucleate a more uniform structure. Examples include TiC, TiN, TiCN/alumina and zirconia/alumina.

In yet another embodiment, the coatings of the present invention may be thermally grown coatings applied for oxidation resistance to form a dissolution barrier during shell fire. Examples include chromium plate to chromia, aluminide to alumina, and silicide to silica.

A number of different processes may be used to apply the coatings of the present invention to the refractory metal cores. These processes include electrophoretic (EPD) process, i.e., an electrochemical method of depositing powder based coating that can be ceramic, metal, or intermetallic. This is a non line of sight process that offers flexibility in chemistry, structure, and layers. An EPD process can also be aqueous based and low cost.

Another process is dip coating techniques using a sol-gel or preferably a high solids yield coating to create a film. Dip coating reduces line of sight issues.

Physical vapor deposition methods may be used. These methods include a wide array of coating processes including EB-PVD, cathodic arc, plasma spray, and sputtering.

Diffusion coating techniques may also be used. Diffusion coating includes processes such as aluminiding, siliciding, chromizing, and combinations thereof. Oxygen active elements, such as yttrium, zirconium, hafnium, etc., and noble metals such as platinum may be incorporated to form better lasting oxide scales. The coating process may be followed by controlled oxidation to form oxide scales.

An oxide coating may be formed on the refractory metal cores during the preheating of a DS/SX mold in an air furnace up to 1000° C. before putting it into a vacuum furnace to shorten the heat up cycle.

It is apparent that there has been provided in accordance with the present invention refractory metal core coatings which fully satisfy the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A casting system including a refractory metal core, said refractory metal core having means for providing oxidation resistance during shell fire and protection against reaction/dissolution during casting, said oxidation resistance and protection means being a coating consisting of aluminum silicate.

2. A casting system in accordance with claim 1, wherein said core is formed from a material selected from the group consisting of tantalum, niobium, tungsten, alloys thereof, and intermetallic compounds thereof.

3. A casting system in accordance with claim 1, wherein said core is formed from molybdenum.

4. A casting system including a refractory metal core, said refractory metal core having means for providing oxidation resistance during shell fire and protection against reaction/dissolution during casting, said oxidation resistance and protection means being a coating consisting of zirconium silicate.

5. A casting system including a refractory metal core, said refractory metal core having means for providing oxidation resistance during shell fire and protection against reaction dissolution during casting, said oxidation resistance and protection means being a coating consisting of an oxide selected from the group consisting of calcia and magnesia.

6. A casting system including a refractory metal core, said refractory metal core having means for providing oxidation resistance during shell fire and protection against reaction/dissolution during casting, said oxidation resistance and protection means comprising a coating contacting said refractory metal core, said coating comprising a nitride selected from the group consisting of silicon nitride, sialon, and mixtures thereof.

7. A casting system including a refractory metal core, said refractory metal core having means for providing oxidation resistance during shell fire and protection against reaction/dissolution during casting, said oxidation resistance and protection means comprising a coating adjacent said core, said coating comprising a carbide selected from the group consisting of silicon carbide, titanium carbide, and mixtures thereof.

8. A casting system including a refractory metal core, said refractory metal core having means for providing oxidation resistance during shell fire and protection against reaction/dissolution during casting, said oxidation resistance and protection means comprising a coating, said coating comprising a ceramic coating and a layer between the refractory metal forming the refractory metal core and said ceramic coating, wherein said layer is formed from a material selected from the group consisting of TiC, and $Si_3N_4$.

* * * * *

UNITED STATES PATENT AND TRADEMARK OFFICE

CERTIFICATE OF CORRECTION

PATENT NO. : 7,575,039 B2
APPLICATION NO. : 10/685631
DATED : August 18, 2009
INVENTOR(S) : Beals et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 662 days.

Signed and Sealed this

Seventh Day of September, 2010

David J. Kappos

David J. Kappos
*Director of the United States Patent and Trademark Office*